United States Patent [19]

Frank

[11] 4,055,024

[45] Oct. 25, 1977

[54] ROOF WINDOW ARRANGEMENT

[75] Inventor: Wilhelm Frank, Leinfelden, Germany

[73] Assignee: Wilh. Frank GmbH, Leinfelden, Germany

[21] Appl. No.: 682,335

[22] Filed: May 3, 1976

[30] Foreign Application Priority Data

May 3, 1975 Germany ..... 2519856

[51] Int. Cl.[2] ..... E05D 15/48

[52] U.S. Cl. ..... 49/153; 49/192; 49/390

[58] Field of Search ..... 49/192, 149, 390, 392, 49/393, 386, 153

[56] References Cited

U.S. PATENT DOCUMENTS

| | | | |
|---|---|---|---|
| 1,005,344 | 10/1911 | Soule | 49/153 |
| 3,122,799 | 3/1964 | Lunde | 49/192 X |
| 3,728,818 | 4/1973 | Lovatt | 49/192 |

FOREIGN PATENT DOCUMENTS

| | | | |
|---|---|---|---|
| 526,747 | 3/1954 | Belgium | 49/192 |
| 1,213,290 | 3/1966 | Germany | 49/192 |
| 2,034,335 | 1/1972 | Germany | 49/192 |
| 315,835 | 10/1969 | Sweden | 49/192 |

*Primary Examiner*—Philip C. Kannan
*Attorney, Agent, or Firm*—Hans Berman

[57] ABSTRACT

A roof window whose installed frame has upper and lower horizontal members and obliquely sloping side members has a casement attached to the upper frame member by two links fastened by fixed pivot pins to the respective center portions of the side rails of the casement and to the two ends of the upper frame member. Slides on the side rails slide along the side members of the frame when the links pivot on the upper frame member while the casement pivots on the links. The casement may be locked to the links for joint movement about the pivot pins on the upper frame member toward and away from the closing position of the casement in which the casement closes the opening bounded by the members of the frame. The slides abuttingly engage the side members of the frame in the closing position of the casement and move away from the frame members when the casement swings jointly with the links away from the closing position.

12 Claims, 4 Drawing Figures

ROOF WINDOW ARRANGEMENT

This invention relates to a roof window arrangement and particularly to an improved arrangement for moving the casement of a roof window relative to the associated frame, the term "roof window" being employed herein to designate a window whose pane is obliquely inclined to the horizontal in the installed condition of the window.

Casements of roof windows are usually pivoted on the window frames about a horizontal axis at the top of the casement or about a horizontal axis passing approximately through the center of gravity of the casement. The first kind of known roof windows will be referred to hereinafter as the awning type and the second kind as the swinging type. It is an advantage of the awning type that the casement may be opened without projecting into the house, thus permitting convenient access to the window opening. It is difficult to wash the outer face of an awning-type casement from inside the house. The outer face of a casement of the swinging type is conveniently washed from inside the building, but the casement projects into the house when the window is open, thereby interfering with free access to the window opening and with the installation of window shades and drapes.

It is known from the German published patent application No. 2,421,919 to provide the casement of a roof window with laterally projecting stub shafts which are slidably received in guide ways in the obliquely sloping side members of the window frame. While the casement of the German application still projects into the house when swung open, it may be shifted upward in the frame so as not to obstruct the window opening. However, means must be provided for balancing the weight of the casement, and the operation of the window is relatively inconvenient.

It is an important object of this invention to provide a roof window combining the advantages of the awning type and of the swinging type in a simple manner while avoiding the shortcomings of both and of the device of the German application referred to above.

With this and other objects in view, as will hereinafter become apparent, the window arrangement of the invention has a frame including a plurality of members which jointly bound a window opening in the frame. One of the members extends horizontally in the normal, installed condition of the frame, and two other members extend downward from the one member and are separated by the window opening. A casement is movable toward and away from a closing position in which it closes the window opening. Elongated links have each a first end portion fastened to the frame for pivotal movement about a first axis fixed relative to the links and to the frame adjacent the afore-mentioned normally horizontal member. A second end portion of each link is fastened to the casement for pivotal movement of the casement relative to the links about a second, fixed axis spaced from the first axis and remote from the horizontal frame member and parallel to the first axis. The casement may be locked to the links for joint movement therewith about the first axis toward and away from its closing position. Two slides on the casement respectively engage the downwardly extending frame members for sliding movement on the engaged members toward and away from the horizontal frame member during pivotal movement of the casement about the second axis while the links pivot about the first axis. The slides abuttingly engage the two downwardly extending frame members in the closing position of the casement and move away from the two members during the joint movement of the casement with the links away from its closing position.

Other features, additional objects, and many of the attendant advantages of this invention will readily be appreciated as the same becomes better understood by reference to the following detailed description of a preferred embodiment when considered in connection with the appended drawing in which.

Figure 1:
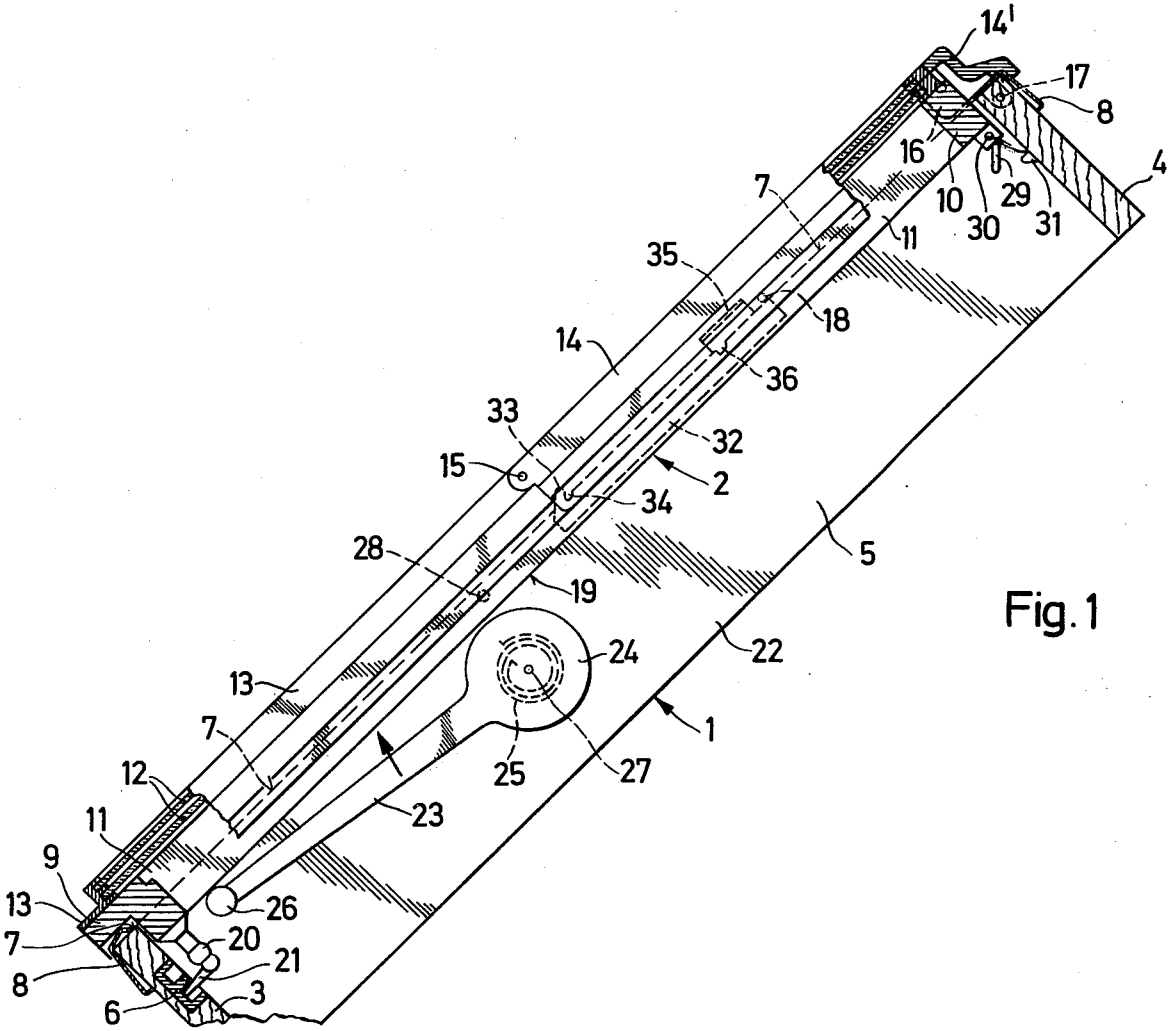
FIG. 1 shows a roof window of the invention in the closed position, the view being in side elevation, one side of the frame, two corners of the casement, and other elements being broken away to reveal otherwise obscured features.

Referring now to the drawing in detail, and initially to FIG. 1, there is shown a roof window of the invention in its normal installed position in which its frame 1 is obliquely inclined relative to the horizontal. In the illustrated condition of the window, the rectangular opening in the frame 1 is closed by a casement 2 which sealingly engages the lower horizontal member 3 and the two downwardly sloping side members 5 of the frame 1, one side member 5 being broken away for convenient pictorial representation of the window.

The four frame members are wooden boards whose narrow faces 7 are directed obliquely upward and are protected by sheet metal cladding 8. The lower horizontal rail 9 and the lower portions of the two obliquely sloping side rails 11 of the casement 2 rest on the cladding 8 when the casement closes the window opening, but the upper casement rail 10 is received within the window opening adjacent the upper horizontal frame member 4. A pane 12 having two layers of glass separated by air is mounted on the rails by means of an extruded aluminum molding 13.

The casement is suspended from the upper horizontal frame member 4 by means of two links 14 of somewhat resilient aluminum alloy hingedly fastened to the side rails 11 of the casement 2 by respective pivot pins 15 whose common horizontal axis passes approximately through the center of gravity of the casement. The upper ends of the links 14 carry brackets 16 which are attached to the frame member 4 by pivot pins 17. The links 14, of which only one is seen in the drawing, are the leg elements of an approximately U-shaped link assembly and are connected by a transverse connecting element 14' having the same, approximately L-shaped cross section as the links 14. In the illustrated closed condition of the window, the link assembly 14, 14' has the added function of preventing passage of rain water between the upper parts of the frame 1 and the casement 2.

Coaxial, cylindrical slides 18 project laterally outward from the two side rails 11 of the casement 2 approximately midway between the pivot axes defined by the pins 15, 17 at the two ends of each link 14. The inner faces 19 of the side rails 11 and of the other casement rails are visible and accessible from inside the house in whose slanting roof the window is installed, and a handle 20 rotatably mounted in the center of the lower casement rail 9 carries a latch 21 which engages a metal receptacle 6 recessed in the lower frame member 3 to hold the casement 2 in the closing position.

The wide, exposed, inner face 22 of each side member 5 of the frame 1 carries an arm 23 parallel to the face 22. A hub disc 24 is integral with one end of the arm 23 and a cylindrical engagement member 26 with the other end. The hub disc 24 covers a spiral spring 25 attached to the disc and to a stub shaft 27 on which the disc is rotatably mounted. Only one of the two arms 23 and associated elements are seen in the drawing, the other arm assembly being a mirror image of what is specifically shown. The springs 25 bias the arms 23 clockwise into abutting engagement of the members 26 with the inner faces 19 of the casement rails 11. An abutment pin 28 on the frame member 5 limits movement of the arm 23 under the force of the spring 25.

A heavy wire bar 29 extends horizontally along the central part of the upper casement rail 10. Only one of its two ends, offset at right angles to the main portion of the bar, is seen in the drawing and is hingedly fastened to a bracket 30 on the rail 10. When swung manually counterclockwise from the position shown in FIG. 1, the bar 29 may be engaged with a locking catch 31 on the upper frame member 4 as will presently be described, the bar being sufficiently resilient to permit manual transverse displacement of its center portion toward and away from the catch 31.

Figure 2:
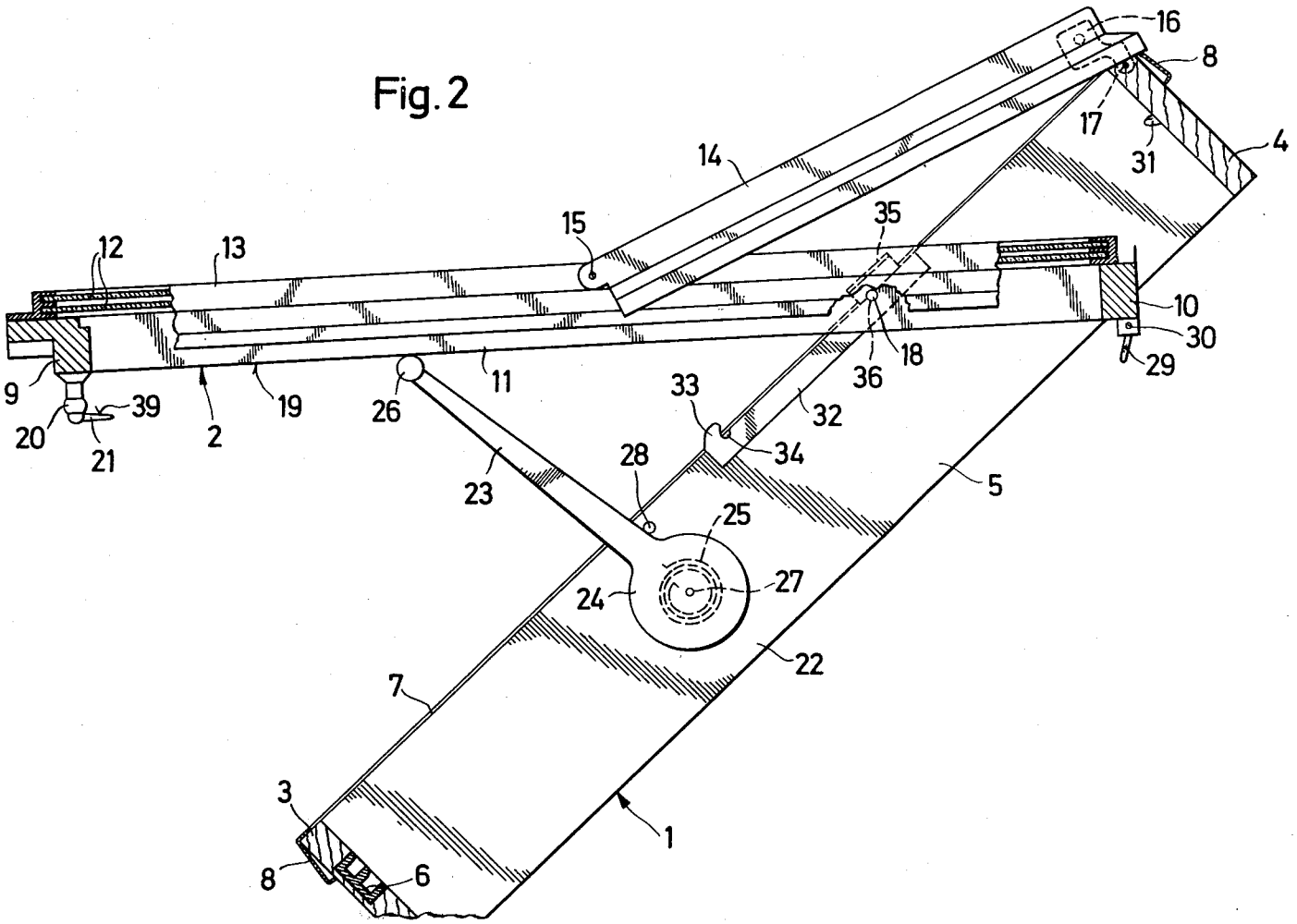
FIG. 2 shows the window of FIG. 1 in the ventilating position.
Figure 3:
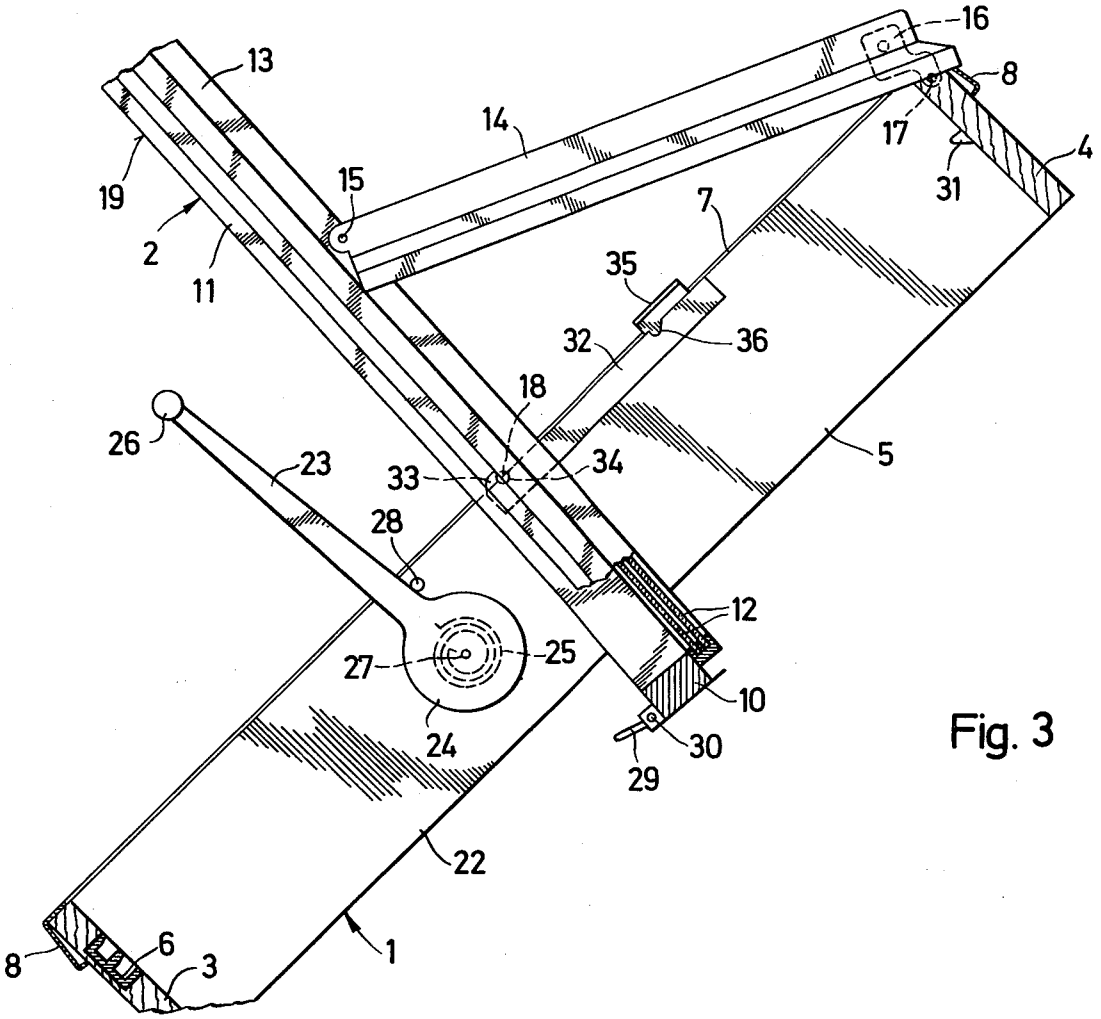
FIG. 3 illustrates the same window in the cleaning position.
Figure 4:
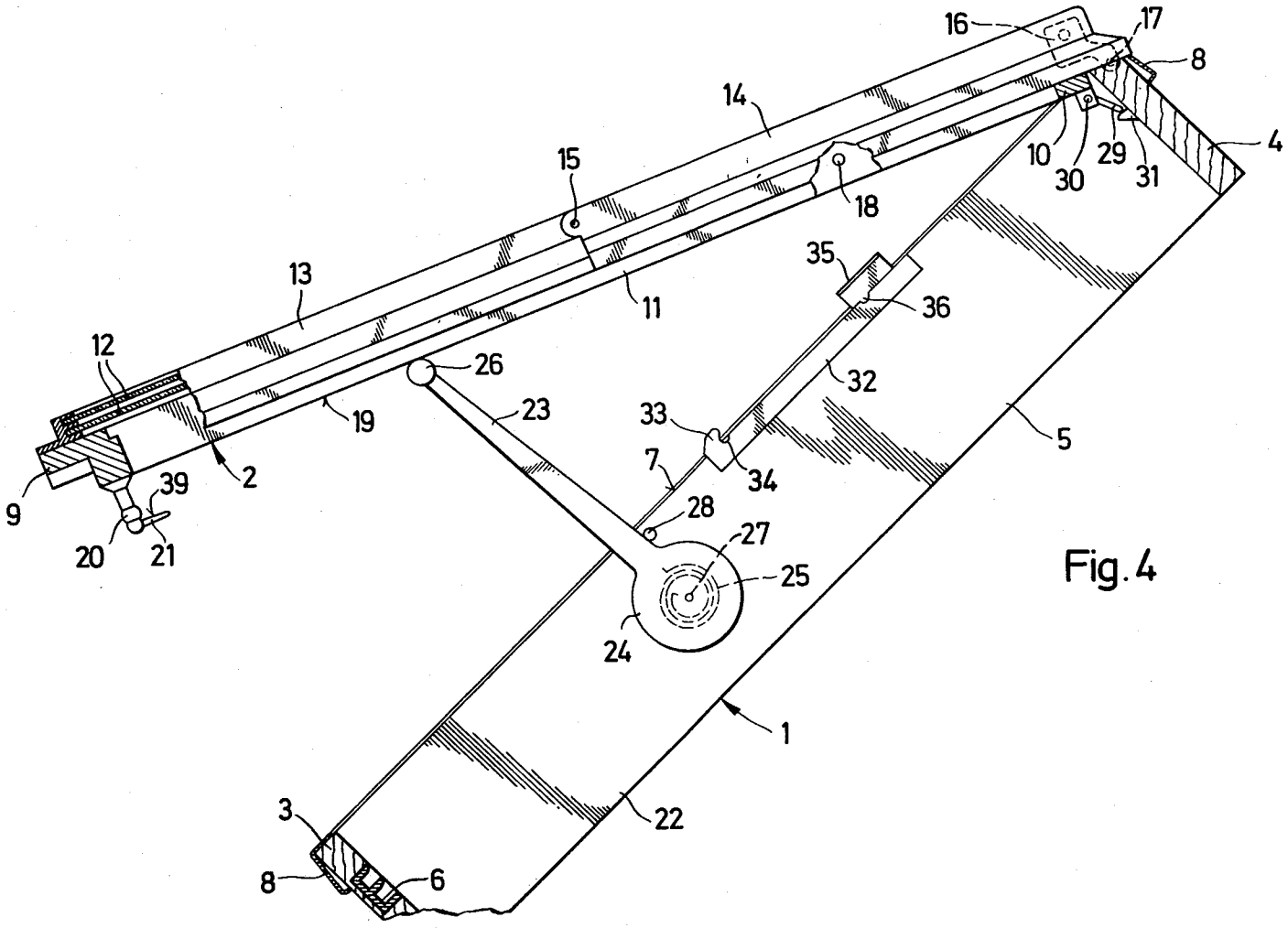
FIG. 4 shows the window in yet another operating position, the views of FIGS. 2 to 4 corresponding to that of FIG. 1.

As is better seen in FIGS. 2 to 4, a plastic guide molding 32 of L-shaped cross section extends along a portion of the face 7 of each lateral frame member 5 for engagement by the metallic slides 18 at minimal friction. The lower end of the molding 32 has an integral hook 33 transversely projecting beyond the face 7 and spacedly covering a cylindrically arcuate notch 34 in the molding 32. Another, similar notch 36 is provided spacedly adjacent the upper end of the molding 32 and is associated with a short channel section 35 of U-shaped cross section integral with the molding 32 one of whose flanges is spacedly parallel to the face 7 and the molding 32 to guide a slide 18 into and out of the notch 36.

The operation of the window will now be described with reference to FIGS. 2 to 4. When the handle 20 is turned to release the latch 21 from the receptacle 6, the spring-loaded arm 23, aided by pressure manually applied to the handle 20, pushes the lower end of the casement 2 upwardly out of the plane of the frame 1, thereby causing the casement to pivot on the links 14 about the common axis of the pins 15, and the link assembly 14, 14' to pivot on the pins 16. The slides 18 move from their initial position at the upper end of the moldings 32 downward along the narrow faces 7 of the lateral frame members 5 until they drop into the notches 36. Simultaneously, the arms 23 engage the abutments 28, and the window arrangement reaches the stable ventilating position shown in FIG. 2.

In this position, warm air may flow out of the house through the portion of the window opening between the casement 2 and the upper frame member 4 while cold air may enter below the casement through a much larger portion of the window opening which provides an unobstructed view.

When it is desired to wipe or wash the outer face of the pane 12 from inside the house, the wire bar 29 provides a convenient handle by means of which the casement may be lifted slightly from the ventilating position of FIG. 2 to release the slides 18 from the notches 36, an excessive lifting movement being prevented by the flange of the channel section 35. Thereafter, the slides 18 guide further tilting movement of the casement 2 on the pins 15 by the hand holding the bar 29 until such movement is stopped by the hook 33, and the slides 18 drop into the notches 34. The resulting position of the casement 2 is shown in FIG. 3. Although no longer backed by the arms 23, the casement is adequately secured to permit cleaning of its outer face even in reasonably strong wind. If the wind pressure is sufficient to tilt the casement 2 by forcing the slides 18 out of the notches 34, the arms 23 catch the side rails 11 and prevent damage to the window or injury to a person by slowing the casement.

When it is desired to open the window in the manner available with awning-type windows, the wire rod 29 is abuttingly engaged with the catch 31 before the handle 20 is turned to release the casement from the closing position of FIG. 1. The engaged rod 29 and catch 31 lock the casement 2 to the links 14 to prevent movement of the slides 18 along the frame faces 7 and the moldings 32. The arms 23, with or without manual assistance, bias the casement 2 to move jointly with the links 14 from the position of FIG. 1 into that of FIG. 4 about the common axis of the pivot pins 16. The slides 18 are lifted from the lateral rail members 5.

To return the casement 2 from the positions of FIGS. 2 to 4 to the closing position of FIG. 1, the steps described above are reversed in an obvious manner not requiring detailed description.

Some dimensional relationships evident from the drawing and only partly pointed out above are helpful or necessary for smooth operation of the illustrated window. During engagement of the latch 21 with the receptacle 6, respective cam faces on the latch and receptacle cause the casement to be pulled toward the lower frame member 3 when the handle 20 is turned, as is conventional in itself. Because of the slides 18 engaging the narrow faces 7 of the lateral frame members 5, the plane defined by the casement 2 in the closing position of FIG. 1 is tilted by the latch 21 through a small acute angle relative to the plane defined by the members of the frame 1, the two planes diverging from the lower frame member 3 toward the upper frame member 4. The portion of the casement 2 between the slides 18 and the upper horizontal rail 10 is pressed against the links 14. The somewhat resilient material of the links yields under the pressure, but resumes its relaxed shape when the latch 21 is released from the receptacle 6.

The tight engagement between the links 14 and the casement 2 ensures water-tightness of the closed window without need for elaborate resilient sealing elements. Additionally, the relaxing links 14 assist in releasing the casement 2 from the frame 1 when the latch 21 is disengaged from the receptacle 6, yet the resilient restraint of the links 14 is overcome without conscious effort by a person turning the handle 20 for latching the casement in the closing position.

When the casement 2 is moved from the closing position of FIG. 1 into any one of the positions seen in FIGS. 2 and 4 through intermediate positions, not shown, the arm 23, the casement 2, and the frame 1 define triangles in the plane of the drawing. The position of the abutment 28 and dimensions of the several elements are chosen so that the angle of the triangle defined by the arm 23 and the casement 2 is always smaller than 90°. This permits the window to be returned to the closed condition of FIG. 1 without manually releasing the arm 23 from a self-locking position inherent in a larger angle.

When the slides 18 are received in the notches 34, as is shown in FIG. 3, the three common axes of the pivot pins 15, the pivot pins 17, and the slides 18 respectively define a triangle in the plane of FIG. 3 in which the angle defined by the casement 2 and the frame 1 is acute, preferably only slightly smaller than a right angle. The dimensions of the window element which make for this relationship contribute materially to the stability of the casement 2 in the cleaning position of FIG. 3.

The invention has been described with specific reference to a window having a rectangular opening and to correspondingly shaped frame and casement elements. However, many of the advantages of this invention are independent of the specific configuration of the frame and casement. Similarly, these advantages are not bound to the presently preferred application of the window to an opening in an obliquely slanting roof.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A window arrangement comprising:

a. a frame including a plurality of members jointly bounding an opening in said frame,
   1. one of said members extending horizontally in the normal, installed condition of said frame, and
   2. two other members extending downward from said one member in said condition and being separated by said opening;

b. a casement movable toward and away from a closing position in which said casement closes said opening;

c. elongated link means having a first end portion fastened to said frame for pivotal movement of said link means about a first axis fixed relative to said link means and to said frame, said first axis being adjacent said one member, said link means having a second end portion fastened to said casement for pivotal movement of said casement relative to said link means about a second axis spaced from said first axis and remote from said one member and parallel to said first axis, said second axis being fixed relative to said casement and to said links;

d. locking means for locking said casement to said link means for joint movement of said casement with said link means about said first axis toward and away from said closing position of said casement; and e. two slide members on said casement respectively engaging said two other members of said frame for sliding movement on the engaged slide members toward and away from said one member during said pivotal movement of said casement about said second axis while said link means pivots about said first axis, said slide members abuttingly engaging said two members in said closing position of the casement and moving away from said two members during said joint movement of the casement away from said closing position.

2. An arrangement as set forth in claim 1, wherein said slide members are located intermediate said axes in said closing position of said casement, the arrangement further including cooperating latching means on said frame and on a portion of said casement spaced from said second axis in a direction away from said first axis for preventing movement of said casement away from said closing position, and a spacer arm movably mounted on said frame and abuttingly engageable with said casement for holding said casement in a position angularly spaced from said closing position relative to each of said axes.

3. An arrangement as set forth in claim 2, wherein said arm is secured to said frame for pivotal movement, yieldably resilient means biasing said arm to pivot toward engagement with said casement, and abutment means on said frame engageable by said arm for limiting said pivotal movement.

4. An arrangement as set forth in claim 3, wherein said arm, said casement, and said frame define a triangle in a plane transverse to said axes when said casement is away from said closing position, the angle of said triangle defined by said arm and said casement in all positions of engagement of said casement by said arm being smaller than 90°.

5. An arrangement as set forth in claim 4, wherein said arm in all said positions of engagement engages a portion of said casement spaced from said second axis in a direction away from said first axis.

6. An arrangement as set forth in claim 3, further comprising stop means on said other members of said frame limiting said sliding movement of said slide members away from said one member.

7. An arrangment as set forth in claim 6, further comprising guide means on each of said other members guiding said slide members during said sliding movement away from said one member, said guide means bounding respective notches adjacent said stop means dimensioned to receive said slides for angular movement of said casement relative to said frame about a third axis parallel to said first and second axes.

8. An arrangement as set forth in claim 7, wherein each of said guide means bounds another notch spacedly intermediate said stop means and said first axis and dimensioned to receive said slide members, said slide members being positioned to be received in said other notch of each guide means when said arm simultaneously engages said abutment means and said casement.

9. An arrangement as set forth in claim 7, wherein said first, second, and third axes define a triangle perpendicular to said axes when said slide members are received in said notches, the angle of said triangle defined by said casement and said frame being acute.

10. An arrangement as set forth in claim 7, wherein said guide means include means for limiting movement of said slide members out of said notches in a direction transverse to the direction of said sliding movement.

11. An arrangement as set forth in claim 1, wherein said locking means include respective locking members secured on said casement and on said one member of said frame, one of said locking members being manually movable into engagement with the other locking member while said casement is in said closing position.

12. An arrangement as set forth in claim 2, wherein said frame and said casement define respective planes parallel to said axes, engagement of said slide members with said two members of said frame in said closing position of the casement maintaining said planes at a small acute angle, said planes diverging in a direction toward said one member, said link means including two link members of resilient material extending between said axes and resiliently deformed by engagement with a part of said casement intermediate said axes in said closing position of said casement.

* * * * *